United States Patent [19]

Nelson et al.

[11] Patent Number: 4,480,986

[45] Date of Patent: Nov. 6, 1984

[54] LIQUID FUEL VAPORIZING BURNER

[75] Inventors: Richard H. Nelson; Ray G. Christensen, both of Bellevue; David Stedman, Redmond, all of Wash.

[73] Assignee: Sea-Labs, Inc., Bellevue, Wash.

[21] Appl. No.: 532,270

[22] Filed: Sep. 14, 1983

[51] Int. Cl.[3] ..... F23N 1/00

[52] U.S. Cl. ..... 431/37; 431/41; 431/208; 431/243

[58] Field of Search ..... 431/208, 215, 242, 243, 431/24, 26, 78, 80, 37, 41

[56] References Cited

U.S. PATENT DOCUMENTS

| | | | |
|---|---|---|---|
| 2,486,481 | 11/1949 | Kissam | 126/93 |
| 2,810,260 | 10/1957 | Fromm et al. | 60/39.71 |
| 3,361,183 | 1/1968 | Reichhelm . | |
| 3,529,812 | 9/1970 | Wunning | 263/19 |
| 3,684,423 | 8/1972 | Bryant | 431/24 |
| 3,756,764 | 9/1973 | Reichmann . | |
| 4,088,437 | 5/1978 | Holzapfel | 431/161 |
| 4,298,334 | 11/1981 | Clark et al. | 431/24 |
| 4,364,724 | 12/1982 | Alpkvist | 431/242 |
| 4,389,185 | 6/1983 | Alpkvist | 431/242 |
| 4,412,328 | 10/1983 | Homa | 431/24 |

*Primary Examiner*—Carroll B. Dority, Jr.

*Attorney, Agent, or Firm*—Dula, Shields & Egbert

[57] ABSTRACT

A liquid fuel vaporizing burner comprising a combustion chamber, a fuel inlet, a primary air inlet, a secondary air inlet, and a microprocessor controller. The fuel inlet communicates with the combustion chamber. The primary air inlet communicates with the combustion chamber and is interactive with the fuel inlet. The heated secondary air inlet extends about the combustion chamber in heat exchange relationship. The combustion chamber has walls of generally heat conductive material. The combustion chamber comprises a combustion region and an exhaust region. The secondary air inlet opens at one end to the atmosphere and at its other end to a mixing passage. The microprocessor controller is electrically connected to thermocouples about the burner, to the primary and secondary air inlets, and to the fuel inlet.

20 Claims, 3 Drawing Figures

CONTROLLER LOGIC OVERVIEW

Best Available Copy

LIQUID FUEL VAPORIZING BURNER

TECHNICAL FIELD

The present invention relates in general to burners having the capacity to vaporize fuel and mix with air at a controlled ratio prior to combustion. More particularly, the present invention relates to a burner construction in which liquid fuel is atomized and then vaporized by hot air that has passed in a heat exchange relationship with the combustion chamber.

BACKGROUND ART

Diesel oil, because of its operational safety benefits, high heat of combustion, and promise of improved gains, has found wide acceptance in land-based industrial power generating and heating systems, the commercial trucking industry, private passenger road vehicles, as well as commercial marine vessels and private pleasure boats. As a result, a reliable and broad distribution system had evolved to satisfy these markets, assuring its availability.

Considering the case of the smaller commercial vessels, (e.g. fishing boats), and private pleasure boats, the intermittant operational duty cycle of their propulsion engines cannot provide a constant source of heating by using the propulsion engine waste heat; and consequently, the industry supporting this application has evolved around auxiliary heating systems utilizing bottled gas, kerosene, and diesel oil. Gasoline fueled heaters have not found a significant market even in those cases where a gasoline powered propulsion system and its attendant storage system and components were already available.

In terms of the energy storage capacity of a separate fuel system for heating fuel, the bottled gas systems are deficient compared to liquid fuels such as kerosene and diesel oil. In the final case, for diesel powered propulsion systems, the diesel oil heating systems require no additional storage nor separate dock servicing for the heating system.

In the past, liquid fueled combustion heater systems have depended upon "pot" and "wick" type burners as well as the broadly used applications of liquid fuel atomizers discharging into relatively large "plenum type" combustion chambers. None of the above specifically produce fully vaporized, homogeneous, fuel/air ratios prior to combustion to maximize the combustion efficiency. In addition, when considering the liquid fuel atomized plenum chamber arrangement, attempts to obtain high heat release per cubic foot of combustion chamber has resulted in an uneven rate of heat release coupled with the accoustics of the plenum to produce undesirable noise and vibration.

The prior art has made some effect to overcome the problems noted; namely, low combustion efficiency, noise and vibration, and increased heat release per unit of combustion chamber volume. U.S. Pat. No. 2,486,481 describes a liquid fuel burner which is a stove comprising a pair of tubular members that are assembled in such a way as to preheat the air moving into the combustion chamber, either by natural or forced draft. U.S. Pat. No. 2,810,260 shows a prevaporizer type of combustion chamber having a longitudinally moveable prevaporizer tube. U.S. Pat. No. 3,529,812 is an industrial burner having a recuperative air preheating device including an air duct cylinder mounted about the burner and forming an annular gap between the air duct cylinder and a jacket tube. U.S. Pat. No. 4,088,437 is a combustion chamber with an evaporator projecting into the combustion zone of the flame tube. These prior art patented devices provide complex arrangements for preheating and vaporizing incoming fuel. In addition, these devices fail to offer the necessary controls for the safe and efficient operation of the devices. None of these prior art devices has incorporated microprocessor controls for offering maximum efficiency in the usage of the burner systems.

It is an object of the present invention to provide a vaporizing burner which effectively and efficiently burns liquid fuel.

It is another object of the present invention to provide an oil vaporizing burner of simplified construction.

It is still another object of the present invention to provide a burner which is capable of using vaporized oil as fuel for attaining high combustion efficiency.

It is a further object of the present invention to provide a high efficiency oil burner which is quiet in operation.

It is an additional object of the present invention to provide a liquid fuel burner including a microprocessor temperature and burner control for automatically monitoring and controlling the operation of the burner.

These and other objects and advantages of the present invention will become apparent from a reading of the attached specification and appended claims.

DISCLOSURE OF THE INVENTION

The present invention is a fuel vaporizing burner comprising: a combustion chamber; a fuel inlet communicatively connected to the combustion chamber; a primary air inlet communicatively connected to the combustion chamber and interactive with the fuel inlet, and a secondary air inlet extending about the combustion chamber in heat exchange relationship.

The fuel inlet comprises a conduit connected to a supply of fuel, an atomizer connected to the conduit, and a mixing passage opening to the atomizer and communicating with the combustion chamber. The atomizer serves to convert the liquid fuel stream into droplets of fuel. The mixing passage is a carburetion and vaporizing tube having a heating element attached thereto.

The primary air inlet delivers air and atomized fuel to the carburetion and vaporizing tube. This primary air inlet comprises a conduit connected to a supply of air. This conduit communicates with the carburetion and vaporizing tube. The primary air inlet includes a pressure regulator for controlling the pressure of the air introduced to the mixing passage.

The secondary air inlet passes heated air to the combustion chamber. This secondary air inlet opens at one end to the atmosphere and the other end to the mixing passage and to the combustion chamber. The secondary air inlet is arranged about the combustion chamber so as to cause the air to pass in close proximity to the combustion chamber. This secondary air inlet includes a blower for drawing the air from the atmosphere and passing it to the combustion chamber.

The combustion chamber is a volume having walls made of generally heat conductive material. This combustion chamber comprises a combustion region generally communicating with the fuel inlet and the primary and secondary air inlets, and an exhaust region extending from the combustion region such that the products of combustion pass therethrough. The combustion region includes a burner diffuser connected so as to receive the mixed air and fuel from the fuel inlet and the primary and secondary air inlets. The burner diffuser has a plurality of holes arranged thereabout. The combustion chamber has a base plate having holes arranged so as to communicate with the secondary air inlet.

The liquid fuel vaporizing burner further comprises a microprocessor controller interactive with the primary and secondary air inlets, and the fuel inlet. This microprocessor controller is responsive to temperatures in the combustion chamber and mixing passage so as to regulate the introduction of fuel and air into the vaporizing burner. The input to the microprocessor controller is transmitted by thermocouples arranged about the combustion chamber and the mixing passage and by a thermostat exterior to the burner system.

BEST MODE FOR CARRYING OUT THE INVENTION

Figure 1A:
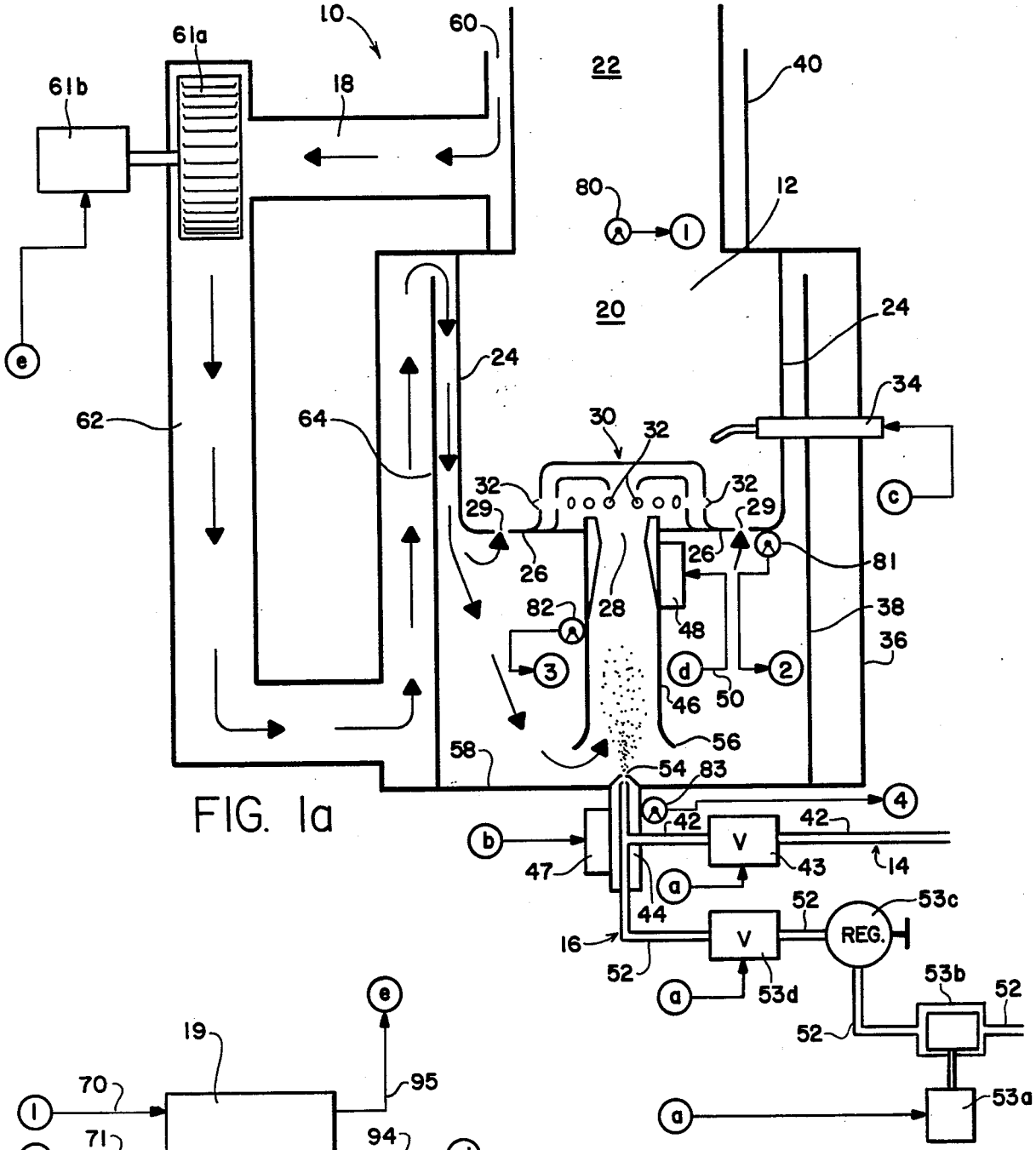
FIG. 1A is a cross-sectional view in side elevation of the diesel oil vaporizing burner of the present invention.
Figure 1B:
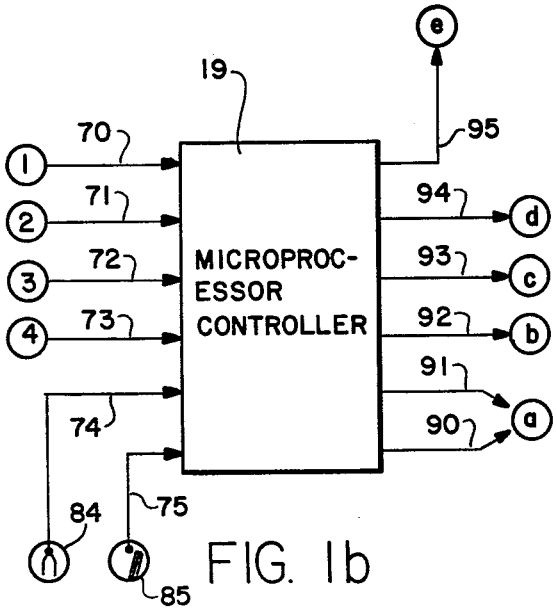
FIG. 1B is a view of a microprocessor controller used to control the burner of FIG. 1A.

Referring to FIG. 1, there is shown a liquid fuel vaporizing burner, according to the present invention, at 10. Liquid fuel vaporizing burner 10 comprises a combustion chamber 12, a fuel inlet 14, a primary air inlet 16, a heated air inlet 18, and a microprocessor controller 19. Each of these elements interact to form the vaporizing burner 10 of the present invention.

Combustion chamber 12 has a central combustion region 20 and an exhaust region 22. Combustion region 20 is the region in which the combustion of the diesel oil is completed. Region 20 has walls 24 comprised of a generally heat conductive material. Typically, walls 24 may include fins (not shown) designed to transfer heat to the air from inlet 18. The base 26 of combustion region 20 includes a principal opening 28, and secondary openings 29. Opening 28 allows the fuel/air mixture to pass into the combustion region 20. Openings 29 are arranged about the base plate so as to allow additional air to enter the combustion chamber 20. In the preferred embodiment, the base plate 26 has a plurality of openings 29 drilled through it. These openings 29 are arranged so as to be readily inward from the perimeter of the base plate. These holes 29 add secondary air directly to the combustion process. This serves to lean out the mixture, improving the efficiency of the combustion process. This air also cools the walls 24 of combustion chamber 20 so as to prevent overheating of the secondary air passing alongside the walls and to prevent preignition of the fuel/air mixture.

A burner diffuser 30 is positioned within combustion region 20 generally above base 26 and opening 28. As will be described hereinafter, burner diffuser 30 receives the fuel/air mixture entering through opening 28. Small amounts of this mixture pass through holes 32 occurring about burner diffuser 30. In the preferred embodiment, burner diffuser 30 has a large number (256 in the test unit) of holes arranged thereabout. The number of holes will generally vary with the size of the unit. The diffuser assures a "quiet" burner, as opposed to the loud, roaring burners found in the prior art. An igniter electrode 34 extends through wall 24 into the combustion region 20. Igniter electrode 34 is designed so as to suitably direct a spark, or other ignition means, toward the burner diffuser 30. Igniter electrode 34 is connected to microprocessor controller 19, as described hereinafter. The igniter electrode 34 is able to ignite the fuel/gas mixture in combustion chamber 12 upon command from microprocessor controller 19.

Exhaust region 22 opens to and communicates with combustion region 20. Essentially, exhaust region 22 is a "chimney" extending from the combustion region. The products of the combustion process will pass from combustion region 20 into exhaust region 22. Exhaust region 22 allows the products of the combustion process to escape from the combustion chamber 12 and allows the products to be passed to the atmosphere through a heat exchanger or another area.

The combustion chamber 12 is generally surrounded by a housing 36. Housing 36 generally extends about the exterior surface of the combustion chamber. A combustion chamber shroud 38 extends between the walls 24 of combustion region 20 and the housing 36. Also, an exhaust shroud 40 extends about the exterior surface of exhaust region 22.

Fuel inlet 14 has a conduit 42 extending and connecting to a supply of fuel. In accordance with the preferred embodiment, this fuel is #2 diesel oil. A solenoid-actuated valve 43 is arranged about conduit 42 of fuel inlet 14. Valve 43 is electrically connected to microprocessor controller 19. Valve 43 serves to regulate the flow of fuel through conduit 42. Conduit 42 communicates with an atomizing nozzle 44. The fuel passes through conduit 42 into atomizer 44 and is atomized into tiny droplets. These tiny droplets of atomized fuel pass into carburetion and vaporizing tube 46. Atomizer 44 has a glow-plug type heater 47 attached thereto. Heater 47 is electrically connected to microprocessor controller 19. The heater 47 is positioned about the atomizing nozzle 44 so as to impart heat to the fuel/air mixture passing therethrough. This heater 47 serves to bring the nozzle temperature up to the normal operating range for starting. The burner can then operate at a constant fuel pressure head. This eliminates the need for a fuel pressure control and its added complications.

Tube 46 is a tubular member which serves as the vaporizing and mixing region for fuel and heated air. Tube 46 includes a glow-plug type preheater 48. Glow-plug preheater 48 is attached about the diameter of carburetion and vaporizing tube 46. Wire 50 connects glow-plug preheater 48 to microprocessor controller 19. Upon activation, glow plug 48 serves to impart heat by conduction into the interior of carburetion and vaporizing tube 46 and by conduction to diffuser 30 and base 26 of combustion chamber 20.

Primary air inlet 16 includes a conduit 52 that connects with a supply of air. A motor **53*a* and rotary compressor 53*b* are arranged about conduit 52 so as to act on the air passing therethrough. Motor 53*a* is electrically connected to microprocessor controller 19. A pressure regulator 53*c* is included about conduit 52 for maintaining the air input pressure to nozzle 44 at a predetermined constant value. A solenoid-actuated valve 53*d* is disposed along conduit 52 between pressure regulator 53*c* and nozzle 44. Valve 53*d* is interconnected with microprocessor controller 19 for regulating the flow of air into nozzle 44. Conduit 52 extends into atomizing nozzle 44 so as to assist in the atomizing of the fuel from conduit 42. The air from conduit 52, along with the fuel from conduit 42, passes through opening 54 in atomizing nozzle 44. Upon passing through this opening 54, an atomized mixture of fuel and air is introduced into carburetion and vaporizing tube 46. By controlling the primary air pressure and fuel pressure into the atomizing nozzle 44, a basic control of the fuel/air ratio into the combustion zone 20** is achieved.

Carburetion and vaporizing tube 46 is a generally cylindrical member communicating, at one end, with the interior of combustion region 20. This carburetion tube opens through opening 28 of base 26 and passes the fuel/air mixture into burner diffuser 30. The other end 56 of carburetion and vaporizing tube 46 opens to an area generally corresponding to the opening 54 of atomizer 44. End 56 is positioned generally distal the base 58 of shroud 38. This flared end 56 serves to receive the fuel/air mixture from atomizer 44 and to receive the heated air from inlet 18.

Heated air inlet 18 delivers heated air to the flared end 56 of carburetion and vaporizing tube 46. A centrifugal blower 61*a* is included within heated air inlet 18 for pulling air through opening 60 and passing the air through inlet 18 toward carburetion tube 46. Centrifugal blower 61*a* is powered by motor 61*b*. Motor 61*b* is electrically connected to microprocessor controller 19. The microprocessor controller 19 interacts with blower 61*a* so as to increase or decrease air, thereby leaning out or enriching the fuel/air mixture. Heated air inlet 18 forms a passageway generally about the exterior surface of combustion chamber 12. Opening 60 opens to an area generally corresponding to the area between the exhaust shroud 40 and the outer diameter of the exhaust region 22. A conduit 62 communicates with this area further forming the passageway for the passing of heated air toward the carburetion and vaporizing tube 46. This conduit 62 opens to a plurality of finned surfaces 64 generally surrounding the combustion region 20. By passing through this arrangement of finned surfaces, the heated air is drawn in close proximity to the exterior surface of the combustion region 20. As a result, an additional heat exchange effect is created. Upon passing in close proximity to the combustion region 20, the air passes downwardly toward the flared opening 56 of carburetion and vaporizing tube 46. This heated air mixes with the fuel/air mixture in carburetion tube 46. In addition, a certain portion of this heated air passes toward the holes 29 in base plate 26 and directly into combustion chamber 20.

Microprocessor controller 19 is the control system for the liquid fuel vaporizing burner 10 of the present invention. Microprocessor controller 19 is a realtime controller, that is, it utilizes dynamic information from various input devices. The microprocessor controller 19 ascertains the current state of the burner, the previous states of the burner, and in general understands what the burner should do or be doing at any given point in its operation.

As seen in FIG. 1, microprocessor controller 19 has input line 70 from the combustion chamber, input line 71 from the base plate, input line 72 from the carburetion and vaporizing tube, input line 73 from the atomizing nozzle, input line 74 from an external thermostat, and input line 75 from an internal overtemperature detector. Input lines 70–73 are directed to four thermocouples strategically placed about the vaporizing burner. Line 70 is connected to a thermocouple 80 located within combustion chamber 12. Line 71 is connected to and receives data from a thermocouple 81 positioned generally about the base plate 26 of combustion chamber 20. Line 72 is connected to and receives data from a thermocouple 82 positioned generally about the side of carburetion and vaporizing tube 46. Line 73 is connected to and receives information from a thermocouple 83 arranged about the side of atomizing nozzle 44. Line 74 is connected to a digital switch-type thermostat external of the system. This thermostat 84 allows the user of the vaporizing burner to set the burner so as to provide the desired temperature. Finally, line 75 is connected to a digital switch-type over-temperature detector 85 for providing input to the microprocessor controller 19. Over-temperature detector 85 is external to the combustion system and provides a signal to the controller when the temperature of the environment acted on by the burner exceeds a specific safety level.

Microprocessor controller 19 processes the inputs received through lines 70–75 and transmits signals for controlling various aspects of the vaporizing burner of the present invention. Specifically, output lines 90 and 91 transmit signals to solenoid-actuated valves 43 and 53*d* and to primary air compressor motor 53*a*. Output line 92 transmits a control signal to glowplug-type heater 47 on nozzle 44. Output line 93 transmits a signal initiating high voltage at the igniter electrode 34 associated with combustion chamber 12. Output line 94 transmits a control signal to carburetor preheater 48 through line 50. Finally, output line 95 transmits a control signal to the motor 61*b* driving centrifugal blower 61*a*. Microprocessor controller 19 is suitably programmed so as to properly adjust the output in response to the incoming data. This programming serves to maximize the efficiency and operational effectiveness of the liquid fuel vaporizing burner of the present invention. The microprocessor controller 19 is programmed in accordance with the language of Appendix A attached hereto.

The operation of the liquid fuel vaporizing burner 10 is described hereinafter. Initially, the vaporizing burner 10 is cold at the start. In order to begin the operation of the burner, the user of the burner turns on the thermostat 84. The digital input of thermostat 84 is sensed by microprocessor controller 19 and starts a series of events within the vaporizing burner. The activating of the thermostat causes a state change from "off" to "preheat". During preheat, the preheat glowplugs 47 and 48 are turned on and the rate of thermal change is monitored. The preheat area of the burner 10 must reach a predetermined temperature, as monitored by one of the thermocouples, in a predefined maximum period of time. If the predetermined temperature is not reached in this predefined maximum period of time, then an error is detected by the microprocessor controller 19. Any error detected will cause the unit to shut down until appropriate repair is made. Assuming that the temperature requirement is met, the controller 19 will leave this "preheat" phase and go to an "ignition" phase.

During this "ignition" phase, multiple events are enabled. First, the igniter electrode 34 is enabled from a signal passing through line 93. Next, the primary air to the atomizing nozzle 44 is turned on. This is accomplished by activating motor 53*a* associated with rotary compressor 53*b*. This causes air to be drawn through conduit 52, through pressure regulator 53*c*, through solenoid-actuated valve 53*d*, and toward atomizing nozzle 44. The secondary air inlet 18 is then turned on at a low level. This is accomplished by the microprocessor controller 19 transmitting a control signal through line 95 to motor 61*b*. Motor 61*b* actuates centrifugal blower 61*a*, which, in turn, draws air through opening 60 of secondary air inlet 18. Next, the primary air, the secondary air, and the preheaters are maintained in an "on" status until the three functions have stabilized. At this point, the fuel is turned on. Fuel passes through conduit 42, through solenoid-actuated valve 43, and toward atomizing nozzle 44. The primary air and the fuel combine in atomizing nozzle 44 to send tiny droplets of atomized fuel upwardly into and through carburetion and vaporizing tube 46. This fuel/air mixture is warmed suitably by heater 47 in atomizing nozzle 44 and preheater 48 on carburetion tube 46. Glow plug 48 must have the capacity to bring the temperature of the fuel/air mixture to a level sufficient to permit vaporization. This heated fuel/air mixture then passes upwardly from tube 46 through burner diffuser 30 into combustion region 20. As portions of the fuel/air mixture pass upwardly through holes 32 of the burner diffuser 30, the spark from the already activated igniter electrode 34 ignites the fuel/air mixture.

At this point, the multiple thermocouples 80–83 are monitored to establish that the burner did ignite in a proper fashion and that no malfunctions occurred. Assuming that everything functions in the appropriate fashion, and in a predetermined period of time, the microprocessor controller 19 will raise the secondary air pressure in heated air inlet 18, reset the igniter electrode 34, and make a state change from "ignition" to "combustion".

During this combustion phase, as in the previous states, the burner must meet predetermined time and temperature requirements or a failure condition will be noted and corrective action will be taken. Assuming that the burner functions in a normal fashion, the controller 19 will make the next state change from "combustion" to "full-on".

The products of the combustion process are passed upwardly into exhaust region 22. As this is occurring, the walls 24 of combustion region 20 and the walls of exhaust region 22 become hotter. The products of the combustion eventually pass outwardly from exhaust region 22. At this point in time, the heated air inlet properly functions, in terms of introducing heated air to the tube 46 and to combustion region 20. Blower 61*a* draws air in through opening 60 of inlet 18. Blower 61*a* passes this air through conduit 62 and around walls 64. As seen in FIG. 1, the arrows within conduit 62 and walls 64 indicate the flow of heated air through heated air inlet 18. The air passing through opening 60 is initially heated by the heat exchange effect created by the walls of exhaust region 22. The air passing through conduit 62 and about walls 64 is also heated by the heat exchange effect created by the walls 24 of combustion chamber 20. As a result, the temperature of the air passing through inlet 18 is greatly elevated. This heated air flows from inlet 18 into the flared end 56 of carburetion and vaporizing tube 46 and into the openings 29 of base plate 26 of combustion region 20. Once in tube 46, this secondary heated air mixes with the atomized fuel/air mixture so as to vaporize the fuel and supply a predetermined fuel/air mixture to the combustion region. Also, the secondary air passing through openings 29 serves to lean out the mixture and improve burning efficiency. This air also cools the walls 24 of the combustion chamber enough to prevent overheating of the secondary air within inlet 18. This prevents preignition of the fuel/air mixture and flashback or burning in the carburetion tube 46.

The temperature of the heated air entering carburetion tube 46 must be of a sufficiently high temperature to vaporize the fuel/air mixture for combustion. After burner warmup, the glow plug 48 is deactivated since its preheat function has been served. Microprocessor controller 19 deactivates preheat glow plug 48 by a control signal through line 94.

While the burner is in the "full-on" state, the controller 19 monitors normal running temperatures and rate of change of any temperatures from the four thermocouples 80–83. As long as the burner functions in a normal fashion, the controller 19 makes no further functional changes until the thermostat 84 is turned off. In addition to the four thermocouples, there is a failsafe over-temperature detector 85 which is activated when the temperature of the environment about the burner 10 exceeds a specific safety level.

When the thermostat is reset to off, the fuel is turned off by the controller 19 and a cool down period begins. The various air sources remain on until each thermocouple has reached a predetermined low, at which time the various air sources are reset. In the case of a restart, the burner will be checked for appropriate temperatures of the various physical areas of the burner. The controller will either allow further cooling in preparation for a restart or heating of preheat region will be initiated.

Figure 2:
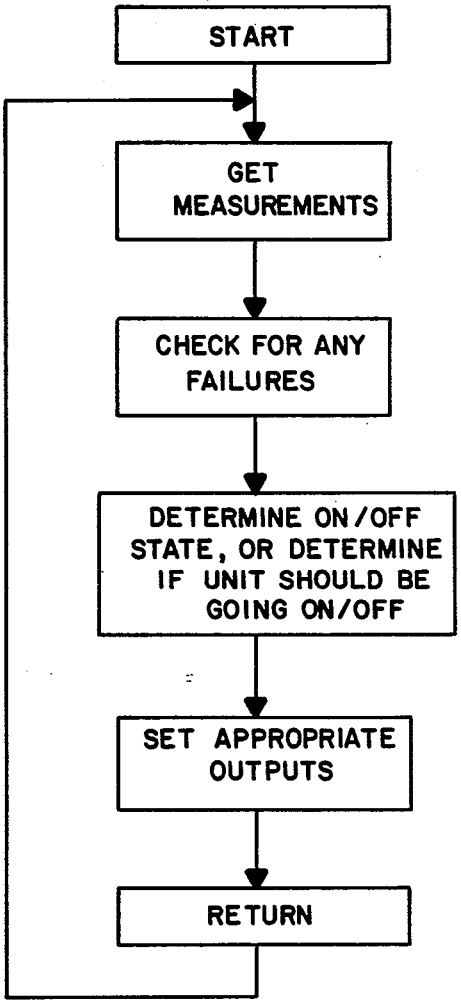
FIG. 2 is a simplified flow chart illustrating the operation of the microprocessor in conjunction with the vaporizing burner of the present invention.

As herein described, the controller has fundamentally four states that it works through to bring up the burner from cold to a full-on functional state. After the burner reaches this full-on state, the controller continues to monitor the performance of the burner and takes remedial steps should a fundamental error occur. A simplified flow diagram of the operation of the microprocessor controller 19 is illustrated in FIG. 2. As can be seen in FIG. 2, initially the microprocessor starts the burner system. After the burner is started, the microprocessor makes measurements, checks for failures, determines on/off states, and sets the appropriate outputs. The measurements are received from the thermocouples 80–83 strategically arranged about the burner and from the over-temperature detector 85 associated with the environment external to the combustion chamber and internal to the furnace assembly. The microprocessor checks for failures by monitoring results and actions of the various components of the burner. For example, if the preheat area of the burner has taken too long to reach the predetermined temperature, a malfunction is detected and a failure recorded. If any failures or malfunctions are detected, the microprocessor will shut off the system so as to allow for repair. If there are no failures or malfunctions, the burner will continue to operate as needed. By monitoring the burner through the associated thermocouples, the microprocessor controller is able to set the appropriate outputs. If a leaner fuel/air mixture is needed, the microprocessor controller can send a signal to the blowers associated with the primary or secondary air inlets so as to increase or decrease the amount of air mixed with the fuel as required. The microprocessor controller 19 continues to follow the steps of FIG. 2 during the operation of the burner.

The present invention offers a number of advantages not found in prior burner systems. A major advantage relates to the use of the microprocessor controller in monitoring and controlling the operation of the burner. Since the microprocessor ascertains the current state and the previous states of the burner, it generally understands what the burner should do or should be doing at any given point in its operation. By optimizing the fuel-/air mixture, the efficiency and effectiveness of the burner are greatly improved. Combustion efficiencies exceeding 85% are believed attainable by this microprocessor controlled burner.

The present invention is also a quiet oil burner. Previous oil burners generate a "roaring" sound. The present invention, however, burns more like a gas stove. The reason for this quiet burning is the diffuser and the multiple holes in the burner head.

While the present invention is particularly suitable for burning #2 diesel fuel, it is also adaptable to kerosene, #1 diesel fuel, jet-fuel A and other oils. Adjustments in the programming of the microprocessor could make the present invention adaptable to a wide variety of burning applications.

There are also many safety considerations that are achieved by the use of the burner of the present invention. The use of the microprocessor temperature and burner controls eliminates the need for special knowledge or training by the user. The thermostat is simply set to the desired temperature and the microprocessor controls to that temperature and monitors the burner to assure that any deviation or malfunction is responded to automatically. As a result, the present invention is a simple, reliable design requiring few critical parts. If any malfunctions occur, then the microprocessor shuts down the burner until appropriate repairs can be effected.

The foregoing disclosure and description of the invention is illustrative and explanatory thereof, and various changes in size, shape, and materials, as well as in the details of the illustrated construction, or described operation, may be made within the scope of the appended claims without departing from the spirit of the invention. This invention should only be limited by the appended claims and their legal equivalents.

We claim:

1. A fuel vaporizing burner comprising:

a combustion chamber;

fuel inlet means communicatively connected to said combustion chamber for delivering fuel to said chamber, said fuel inlet means comprising:

a conduit connected to a supply of said fuel;

an atomizer connected to said conduit, said atomizer for converting said fuel into droplets, said atomizer including a heating element;

means forming a mixing chamber opening to said atomizer and communicating with said combustion chamber; and valving means arranged about said conduit;

said atomizing means including primary air inlet means communicatively connected to said mixing chamber and interactive with said fuel inlet means;

secondary air inlet means extending about said combustion chamber in heat exchange relationship means in communication with said secondary air inlet means for passing air to said combustion chamber and said mixing chamber; and control means interactive with said primary air inlet means and said secondary air inlet means for independently varying the flow rates of said air passing therethrough responsive to temperature conditions within said burner, said heating element and said valving means being responsive to signals from said control means.

2. The burner of claim 1, said combustion chamber having walls of generally heat conductive material.

3. The burner of claim 2, said combustion chamber comprising:

a combustion region; and an exhaust region extending from said combustion region so as to pass the products of combustion therethrough.

4. The burner of claim 1, said mixing chamber being a carburetion tube, said carburetion tube including a heating element attached thereto, said heating element responsive to signals from said control means.

5. The burner of claim 1, said primary air inlet means comprising:

a conduit;

an air compressor arranged in said conduit, said air compressor for delivering air toward said combustion chamber; and valving means in said conduit for controlling the passage of air therethrough, said valving means responsive to signals from said control means.

6. The burner of claim 1, said secondary air inlet means comprising:

blower means for pulling air from the atmosphere and passing said air toward said combustion chamber, said blower means responsive to signals from said control means.

7. The burner of claim 3, said combustion region having holes about its base, said holes communicating with said secondary air inlet means.

8. The burner of claim 1, said control means including at least one thermocouple arranged about the upper portion of said combustion chamber.

9. The burner of claim 1, said control means comprising:

a first thermocouple positioned generally within and about the upper portion of said combustion chamber;

a second thermocouple positioned about said base of said combustion chamber;

a third thermocouple positioned about said mixing chamber;

a fourth thermocouple positioned about said atomizer; and a microprocessor electrically connected to said first, second, third, and fourth thermocouples.

10. The burner of claim 9, said microprocessor being responsive to signals from said first, second, third, and fourth thermocouples, said microprocessor electrically connected to a blower means for said secondary air inlet, said heating element of said atomizer, said valving means of said fuel inlet means, and a valving means for said primary air inlet.

11. A liquid fuel vaporizing burner comprising:

a combustion chamber having walls of generally heat conductive material;

a fuel vaporizing tube communicating with said combustion chamber;

a fuel inlet means communicating with said vaporizing tube for delivering fuel to said vaporizing tube;

heated air inlet means extending about said combustion chamber in heat exchange relationship, said heated air inlet means for passing air to said vaporizing tube;

microprocessor control means electrically connected about said burner, said microprocessor control means having inputs from thermocouples arranged about said combustion chamber, the output of said microprocessor means connected to said fuel inlet means and said heated air inlet means for controlling the fuel/air mixture entering said vaporizing tube; and primary air inlet means for passing air to said vaporizing tube, said primary air inlet means being in fluid communication with said vaporizing tube, said microprocessor control means having an output interactive with said primary air inlet means, said primary air inlet means and said fuel inlet means communicating with said vaporizing tube through an atomizer nozzle.

12. The burner of claim 11, further comprising:

a thermostat electrically connected to said microprocessor control means.

13. A liquid fuel vaporizing burner comprising:

a combustion chamber having walls of generally heat conductive material;

a fuel vaporizing tube communicating with said combustion chamber;

a fuel inlet means communicating with said vaporizing tube for delivering fuel to said vaporizing tube;

heated air inlet means extending about said combustion chamber in heat exchange relationship, said heated air inlet means for passing air to said vaporizing tube;

atomizing means connected to said fuel inlet means, said atomizing means opening to said fuel vaporizing tube, primary air supply means including a control valve connected to said atomizing means;

microprocessor control means electrically connected about said burner, said microprocessor control means having inputs from thermocouples arranged about said combustion chamber, the output of said microprocessor means connected to said fuel inlet means and said heated air inlet means, and said primary air valve for controlling the fuel/air mixture entering said vaporizing tube;

ignition means in said combustion chamber for igniting the mixture from said vaporizing tube; and a diffuser mounted within said combustion chamber, said diffuser receiving the mixture from said vaporizing tube, said diffuser positioned generally adjacent said ignition means.

14. The burner of claim 13, said microprocessor control means electrically connected to a first thermocouple positioned in and about the upper portion of said combustion chamber, a second thermocouple positioned about the base of said combustion chamber, a third thermocouple positioned about said vaporizing tube, and a fourth thermocouple positioned about said atomizer nozzle, said thermocouples being inputs to said microprocessor control means, said microprocessor control means having a first output electrically connected to said heated air inlet means, a second output electrically connected to a heater positioned about said vaporizing tube, a third output electrically connected to said ignition means about said combustion chamber, a fourth output electrically connected to a heater about said atomizer nozzle, and a fifth output electrically connected to said fuel inlet means.

15. The burner of claim 11, said combustion chamber having an exhaust area, said heated air inlet means extending about said exhaust area in heat exchange relationship, said heated air inlet means further including a blower for passing air toward said vaporizing tube.

16. The burner of claim 11, said primary air inlet means comprising:

a conduit;

a compressor arranged in said conduit, said compressor for passing said air to said vaporizing tube;

a pressure regulator arranged in said conduit for controlling the pressure of said air from said compressor; and valving means disposed in said conduit, said valving means and said compressor interactive with said microprocessor control means.

17. A fuel vaporizing burner comprising:

a combustion chamber;

fuel inlet means communicatively connected to said combustion chamber for delivering fuel to said chamber;

primary air inlet means communicatively connected to said combustion chamber and interactive with said fuel inlet means, said primary air inlet means for delivering air to said chamber; and secondary air inlet means extending about said combustion chamber in heat exchange relationship, said secondary air inlet means for passing air to said combustion chamber;

control means interactive with said primary air inlet means and said secondary air inlet means for independently varying the flow rates of said air passing therethrough responsive to conditions within said burner;

a fuel vaporizing tube communicating with said combustion chamber, said primary air inlet means being in fluid communication with said vaporizing tube, said fuel inlet means being in fluid communication with said vaporizing tube region; and a diffuser mounted within said combustion chamber generally adjacent said fuel vaporizing tube, said diffuser receiving the mixture from said vaporizing tube.

18. The burner of claim 17, said fuel vaporizing tube including a heating element attached thereto, said heating element being responsive to signals from said control means.

19. The burner of claim 17, further comprising:

an atomizer nozzle connected to said fuel inlet means and said primary air inlet means, said atomizer opening to said fuel vaporizing tube, said fuel inlet means and said primary air inlet means interactive with said atomizer nozzle for converting said fuel into droplets.

20. The burner of claim 19, further comprising:

a heater attached to said atomizer nozzle and connected to said control means, said heater being responsive to signals from said control means.

* * * * *